US009789514B2

(12) United States Patent
Borrel

(10) Patent No.: US 9,789,514 B2
(45) Date of Patent: Oct. 17, 2017

(54) METHOD OF DRYING AND/OR CURING AN ORGANIC COATING ON A CONTINUOUSLY RUNNING METAL STRIP, AND DEVICE FOR IMPLEMENTING THIS METHOD

(75) Inventor: Pierre-Jérôme Borrel, Saint Chamond (FR)

(73) Assignee: Primetals Technologies France SAS, Savigneux (FR)

( * ) Notice: Subject to any disclaimer, the term of this patent is extended or adjusted under 35 U.S.C. 154(b) by 1854 days.

(21) Appl. No.: 12/991,594

(22) PCT Filed: May 8, 2008

(86) PCT No.: PCT/FR2008/000650
§ 371 (c)(1),
(2), (4) Date: Nov. 8, 2010

(87) PCT Pub. No.: WO2009/136010
PCT Pub. Date: Nov. 12, 2009

(65) Prior Publication Data

US 2011/0059266 A1 Mar. 10, 2011

(51) Int. Cl.
*H05B 6/10* (2006.01)
*F26B 19/00* (2006.01)
(Continued)

(52) U.S. Cl.
CPC ..... *B05D 7/14* (2013.01); *B05D 3/0209* (2013.01); *F26B 3/283* (2013.01); *F26B 3/343* (2013.01);
(Continued)

(58) Field of Classification Search
CPC ..... B05D 2252/02; B05D 3/0209; B05D 3/0263; B05D 3/0272; B05D 3/0281;
(Continued)

(56) References Cited

U.S. PATENT DOCUMENTS 4,239,483 A * 12/1980 Iida et al. ..... 432/8
4,370,357 A 1/1983 Swartz
(Continued)

FOREIGN PATENT DOCUMENTS

DE 196 25 548 A1 1/1998
EP 0132248 A2 1/1985
(Continued)

OTHER PUBLICATIONS

Definition of induction heating comes from Encyclopedia Wikipedia website: http://en.wikipedia.org/wiki/Induction_heating, see attached file, Induction_heating_definition.pdf.*

*Primary Examiner* — Quang D Thanh
*Assistant Examiner* — Ket D Dang
(74) *Attorney, Agent, or Firm* — Laurence A. Greenberg; Werner H. Stemer; Ralph E. Locher

(57) ABSTRACT

A method of drying and/or curing an organic coating on a continuously running metal strip, includes heating the strip by electromagnetic induction in a tunnel furnace having an enclosure with hot internal walls and heating the enclosure. The heating of the strip by electromagnetic induction is coupled with heating by infrared radiation and heating by convection with a combustion gas. The heating of the enclosure of the furnace is performed by convection using the same combustion gas used for heating the strip by convection. A device for implementing the method is also provided.

6 Claims, 2 Drawing Sheets

(51) Int. Cl.

| | |
|---|---|
| ***B05D 7/14*** | (2006.01) |
| ***B05D 3/02*** | (2006.01) |
| ***F26B 3/28*** | (2006.01) |
| ***F26B 3/34*** | (2006.01) |
| ***F26B 13/10*** | (2006.01) |

(52) U.S. Cl.
CPC ..... *F26B 13/10* (2013.01); *B05D 3/0263* (2013.01); *B05D 3/0272* (2013.01); *B05D 3/0281* (2013.01); *B05D 2252/02* (2013.01)

(58) Field of Classification Search
CPC . B05D 7/14; F26B 13/10; F26B 3/283; F26B 3/343
USPC .... 34/247, 68, 443, 444, 493; 219/651, 653, 219/675, 645
See application file for complete search history.

(56) References Cited

U.S. PATENT DOCUMENTS

| | | | | |
|---|---|---|---|---|
| 4,594,266 | A | 6/1986 | Lemaire et al. | |
| 5,059,446 | A | 10/1991 | Winkle, Sr. et al. | |
| 5,586,877 | A | 12/1996 | Charmes | |
| 5,768,799 | A | 6/1998 | Delaunay et al. | |
| 6,180,933 | B1 * | 1/2001 | Demidovitch et al. ..... | 219/655 |

FOREIGN PATENT DOCUMENTS

| | | | |
|---|---|---|---|
| EP | 0 445 556 | A1 | 9/1991 |
| EP | 0744222 | A1 | 11/1996 |
| EP | 0754911 | A2 | 1/1997 |
| EP | 1 508 383 | A2 | 2/2005 |
| FR | 1 553 899 | | 1/1969 |
| FR | 1553899 | A | 1/1969 |

* cited by examiner

METHOD OF DRYING AND/OR CURING AN ORGANIC COATING ON A CONTINUOUSLY RUNNING METAL STRIP, AND DEVICE FOR IMPLEMENTING THIS METHOD

BACKGROUND OF THE INVENTION

Field of the Invention

The invention relates generally to drying and/or curing organic coatings such as paints or varnishes on continuously running metal strips.

Organic coatings such as paints or varnishes are deposited in liquid form on continuously running steel strips. It is therefore necessary to dry and/or cure such coatings before said strips can be deflected or supported by rollers and, of course, before being spooled.

In order to accelerate drying and thus consequently to reduce the length of the facilities, the person skilled in the art is aware of the use of heating devices to accelerate the evaporation of solvents contained in these coatings of an organic nature. Following coating, the steel strips pass into a heated enclosure where the solvents are evaporated and continuously extracted so as to limit their concentration in the enclosure to below the explosion threshold. They are then directed towards incineration units.

A technique in current usage for the drying operation consists in heating the strip by induction. This method gives excellent results since the inductors heat the strip, which, in its turn, heats the coating, which facilitates the evaporation of the solvents.

However, heating by induction has the disadvantage of not heating the walls of the enclosure of the furnace, which has the consequence that their temperature remains below the dew point of the solvents. This gives rise to risks of condensation of solvent vapors on the walls, on the inductor cooling circuits, etc. Apart from the risks of ignition caused by possible accumulations of condensed solvents, drops of condensates may also fall onto the strip during drying and create appearance defects and/or insufficient protection.

In order to overcome these disadvantages, different techniques have been developed, involving heating by induction of the internal walls of the enclosure of a furnace until these walls are at a temperature above the dew point of the solvents. Thus, American Patent U.S. Pat. No. 4,370,357 discloses an installation comprising an enclosure, in which nitrogen circulates constantly in a closed circuit, which makes it possible to lift the temperature of the nitrogen, and thus of the enclosure, above the dew point of the mixture of nitrogen and solvent vapors. The installation comprises, in the nitrogen circulation circuit, a device to separate the solvents and the nitrogen, which is recovered in liquid form. Finally, complex arrangements are made to channel the condensed solvents onto the inductor cooling pipes.

The person skilled in the art has attempted to improve the installation described in U.S. Pat. No. 4,370,357 by installing, in a heating enclosure comprising inductors, continuous blowing of hot air into the enclosure in order to heat the inductors and the walls to above the dew point of the solvents, and also continuous extraction of the hot air/solvent vapor mixture, which is then incinerated. Such a heating method, which is simpler than that in American Patent U.S. Pat. No. 4,370,357, is in particular described in European Patent EP 0 744 222. However, it has the disadvantage of consuming far more energy than that in American Patent U.S. Pat. No. 4,370,357, in particular for heating the air on the one hand and for supplying the incineration burners, on the other.

Furthermore, heating enclosures have been developed comprising additional devices for heating the walls of the enclosure, which are independent of the means of heating the strip. Thus, in European Patent Application EP 1 508 383, additional means of heating such as means of heating by induction or by electrical resistance are installed in the enclosure of the furnace for heating the walls. Such methods certainly resolve the problem of condensation, but at the cost of high energy consumption, which does not contribute even directly to the curing process.

Finally, in European Patent Application EP 0 132 248, means of heating other than induction consisting in particular of sources of infrared radiation are installed in a heating enclosure to heat both the coating and the atmosphere in the enclosure. Even though European Patent EP 0 132 248 indicates that the energy balance of such facilities is improved in comparison with facilities operating with means of heating by induction, this nonetheless requires constant sweeping of the enclosure with an inert gas owing to the risk of ignition of solvent vapors in contact with active elements of infrared radiants. Although the nature of these radiant elements is not explicitly described in EP 0 132 248, the person skilled in the art may reasonably believe that they are electrical (and thus non-catalytic), since their installation in the enclosure requires the absence of oxygen in the enclosure. The invention consequently proposes applying a solution making it possible to retain all the advantages of heating by induction while resolving the problems of condensation of the solvent vapors, but without exhibiting the disadvantages of the above mentioned solutions in the prior art.

BRIEF SUMMARY OF THE INVENTION

More particularly, the object of the present invention is a method of drying and/or curing an organic protective and/or decorative coating on a continuously running metal strip, comprising:

i) heating of the strip by electromagnetic induction in a tunnel furnace, comprising an enclosure with hot internal walls in order to evaporate the solvents contained in the organic coating and ensure the drying and/or curing of the coating, the solvents being continuously extracted from the enclosure of the furnace, and ii) heating of the enclosure in order to maintain said internal walls at a temperature equal to or greater than the dew point of the solvents.

Heating of the strip with its coating by electromagnetic induction has the advantage of heating the organic coating (for example, a paint or a varnish) by supplying heat originating from the strip, which is transmitted by conduction to the coating, along a gradient developing from the interface between the coating and the strip towards the free external surface of the coating, which facilitates the evaporation of the solvents.

Heating of the enclosure to maintain the temperature of its internal walls above the dew point of the solvents makes it possible to limit the risks of condensation of the solvent vapors on the walls of the enclosure in particular, or on the indicator cooling circuits.

According to the present invention, the heating of the strip and its coating by electromagnetic induction is simultaneously coupled to two other modes of heating in addition to the first mode by induction, namely heating by infrared radiation and heating by convection by means of a combustion gas and heating of the enclosure is performed by convection by means of the same combustion gas as that used for heating the strip by convection.

The metal strip may be made from steel, in particular galvanized, or aluminum.

The method according to the invention offers numerous advantages in comparison with the known methods in the prior art mentioned above.

Thus, heating of the strip by infrared radiation exhibits the advantage that the infrared radiation penetrates inside the coating as far as the interface between the strip and the coating, so that the drying and/or curing of the coating takes place from the external surface of the coating to the interface with the strip. This makes it possible to avoid the formation of blisters in the coating, while still ensuring a high curing temperature.

Also, heating by combustion by means of a combustion gas is applied both to the enclosure and to the strip and, more particularly, to the coating along a gradient developing from the free external surface of the coating towards its interface with the strip.

Particularly advantageously, heating by infrared radiation is performed by means of at least one infrared radiation emitter with catalytic burner placed in the enclosure of the tunnel furnace, said emitter comprising a catalytic structure made up of a catalytic element impregnated with a catalytic combustion material onto the surface of which a combustion gas or mixture of air and combustion gas is injected, heating by convection of the walls of the enclosure and the strip being ensured by oxidation of the combustion gas injected on the surface of the catalytic element of said infrared radiation emitter.

This involves an infrared radiation emitter (or catalytic gas radiant) with a very broad wavelength spectrum, ideally between 3 and 10 μm, covering the entire range of wavelengths absorbed by organic coatings, which makes it possible thus to ensure effective drying and/or curing of the organic coating by radiation.

As catalytic gas radiants which can be used according to the present invention, reference may be made in particular to those described in European Patent EP 0 754 911. These are infrared radiation emitters with catalytic burners comprising:

- a box,
- a catalytic structure made up of an element impregnated with a catalytic combustion material,
- a unit for injecting a combustible gas positioned in the box and emerging onto the surface of the impregnated element,
- a turbine air generator sending air under pressure in the box over the entire surface of the impregnated element, and
- means of electrical heating of the impregnated element.

Reference may also be made to the thermo-reactors marketed by the SUNKISS company.

The oxidation of the combustible gas, for example propane or natural gas, on the surface of the catalytic elements also supplies the energy needed for the heating by convection of the enclosure and, in part, the energy needed for the drying and/or curing of the coating without, however, reaching the high temperatures associated with rapid combustion.

Also, the catalytic structures of the catalytic gas radiants ensure partial oxidation of the solvent vapors, which offers the double advantage of reinforcing the heating by convection and reducing the quantity of solvent vapors to be incinerated, which further improves the thermal balance of the operation. The oxidation of the solvent vapors and the relatively low oxidation temperature on the surface of the catalytic elements make it possible to stay outside the conditions for auto-ignition and it is therefore not necessary to provide for sweeping of the enclosure with a neutral gas.

The object of the present invention is also a device for curing and/or drying an organic protective and/or decorative coating first deposited on a metal strip, which may be steel, in particular galvanized, or aluminum, said method comprising:

- a tunnel furnace comprising an enclosure with hot internal walls, said enclosure being fitted with:
  - means of heating by electromagnetic induction of the strip passing through the furnace, and
  - means of heating the walls of the enclosure, and
- means for moving the strip with its organic coating from an inlet located at a first end of the enclosure of the furnace to an outlet located at the other end of said enclosure.

According to the invention, the means of heating the internal walls of the enclosure comprise means of heating by convection by means of a combustion gas, which also constitutes means of heating the strip with its coating, and the device according to the invention also comprises means of heating said strip with its coating by infrared radiation.

Advantageously, the means of heating by infrared radiation and the means of heating by convection are made up of at least one infrared radiation emitter with catalytic burner comprising a catalytic structure made up of a catalytic element impregnated with a catalytic combustion material onto the surface of which a combustion gas or mixture of air and combustion gas is injected.

Advantageously, the infrared radiation emitters used in the device according to the invention are emitters such as those described in European Patent EP 0 754 911 B1 or the SUNKISS thermoreactors, as indicated above.

Advantageously, the means of heating by induction comprise a plurality of inductors distributed along the enclosure between the inlet to the furnace and the outlet, in the direction of travel of the strip.

Advantageously, the means of heating by infrared comprise a plurality of infrared radiation emitters with catalytic burners distributed along the enclosure in the direction of travel and arranged on both sides of the strip.

Preferably, the heating by induction is ensured by several inductors distributed along the enclosure in the direction of travel of the strip and the heating by infrared by batteries of catalytic radiants (or infrared radiation emitters) arranged on both sides of the strip, alternating with the inductors. This fractionated distribution makes it possible to modulate the curing energy supplied by each means of heating along the strip. For example, following the direction of travel of the strip, the bulk of the energy may first be supplied by induction and then, gradually, the share of induction decreases in favor of radiation. Other distributions of the means of heating (in particular, inductors and catalytic radiants) may also be envisaged, depending on the desired modulation of the curing energy.

In order to adapt the distribution of curing energy between induction and infrared along the strip, the device according to the invention advantageously contains a control system capable of adjusting the number and positioning of the inductors in operation as well as their electrical power supply. The same control system is also capable of adjusting the number and positioning of the radiants in operation as well as their supply of gas or air/gas mixture.

Other advantageous characteristics of the invention will become apparent in the following description of certain embodiments given as examples only and represented on the attached drawings:

DESCRIPTION OF THE INVENTION

Figure 1:
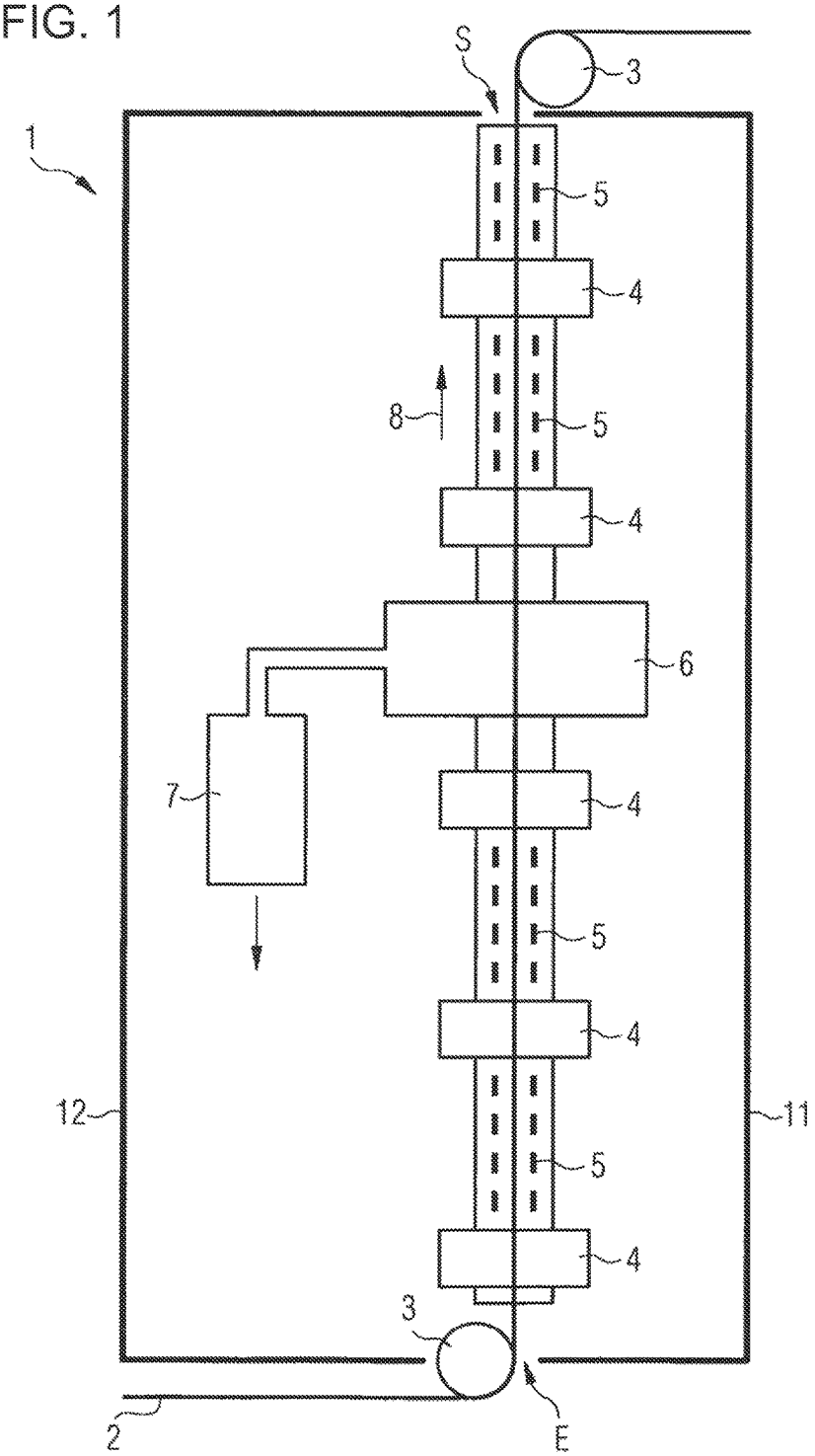
FIG. 1 is a flow diagram in section of a first example of the curing and/or drying device according to the invention.

The curing and/or drying device represented in FIG. 1 comprises a curing and/or drying device 1, commonly also referred to as a furnace, preferably vertical and forming a tunnel, through which a strip of steel 2 passes, on which an organic coating of the varnish or paint type has first been deposited and means 3 (for example deflecting rollers) of moving the strip 2 from an inlet E located at a first end of the enclosure 11 of the furnace 1 to an outlet S located at the other end of said enclosure 11.

The furnace 1 comprises an enclosure 11 with hot internal walls (not represented in FIGS. 1 and 2), which is fitted with: a plurality of inductors 4 distributed along the enclosure 11, and a plurality of infrared emitters with catalytic burners 5 (or catalytic radiants) arranged on both sides of the strip 2 alternating with the inductors 4.

The curing and/or drying device 1 also comprises a recovery chamber 6 for the oxidized gases and residual solvents, which are directed towards an incineration device 7.

The recovery chamber 6 is positioned between two inductors 4 in the middle third of the enclosure 11 of the curing and/or drying device 1. The curing and/or drying device 1 represented in FIG. 2 differs from that represented in FIG. 1 in the position of the recovery chamber 6, which is located in the upper third of the enclosure 11.

Figure 2:
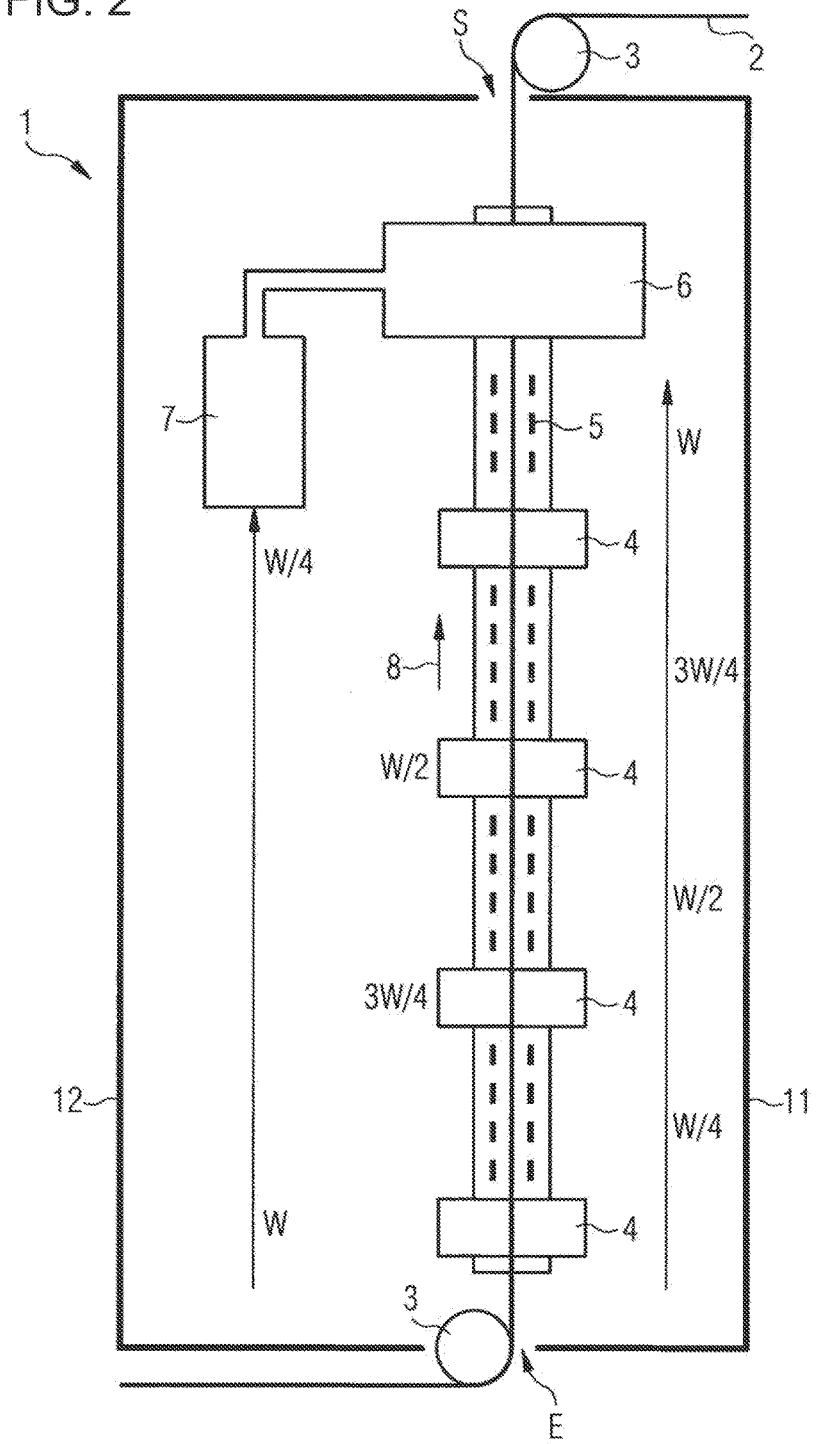
FIG. 2 is a flow diagram in section of a second example of the curing and/or drying device according to the invention.

Also, FIG. 2 also shows a possible example of the distribution of power of the different means of heating, being inductors 4, and burners 5 positioned along the enclosure 11 with, at the bottom of the enclosure, inductors operating at full power (W) in order to facilitate the heating of the coating by conduction from the strip 2 and to promote vaporization of the solvents. The power of the inductors then decreases to reach a low power (W/4) at the top of the enclosure. The catalytic radiants, on the other hand, operate at full power (W) at the top of the enclosure 11 in order to promote cross-linking of the coating and at low power (W/4) at the bottom in order not to hinder the beneficial effect of heating by the strip 2 on the evaporation of the solvents.

The invention claimed is:

1. A device for curing, drying, or curing and drying an organic protective, decorative, or organic protective and decorative coating previously deposited on a metal strip, the device comprising:

a tunnel furnace having an enclosure with hot internal walls, a first end with an inlet and a second end with an outlet;

said enclosure having a moving device for moving the strip with the organic coating from said inlet to said outlet;

said enclosure having each of:

an electromagnetic induction strip heating device for heating the strip passing through the furnace by electromagnetic induction;

a wall heating device for heating the walls of the enclosure and the strip with the coating by convection with a combustion gas; and an infrared radiation device for heating the strip with the coating by infrared radiation.

2. The device according to claim 1, wherein said infrared radiation device for heating by infrared radiation and said device for heating by convection are formed of at least one infrared radiation emitter with a catalytic burner including a catalytic structure formed of a catalytic element impregnated with a catalytic combustion material and having a surface onto which a combustion gas or mixture of air and combustion gas is injected.

3. The device according to claim 1, wherein said electromagnetic induction strip heating device for heating by induction includes a plurality of inductors distributed along said enclosure between said inlet and said outlet in a direction of travel of the strip.

4. The device according to claim 1, wherein said infrared radiation device for heating by infrared radiation includes a plurality of infrared radiation emitters with catalytic burners distributed along said enclosure in a direction of travel of the strip and disposed on both sides of the strip.

5. The device according to claim 1, wherein:

said electromagnetic induction strip heating device for heating by induction includes a plurality of inductors distributed along said enclosure between said inlet and said outlet in a direction of travel of the strip;

said infrared radiation device for heating by infrared radiation includes a plurality of infrared radiation emitters with catalytic burners distributed along said enclosure in said direction of travel of the strip and disposed on both sides of the strip; and said inductors and said infrared emitters are distributed alternately along said enclosure.

6. The device according to claim 5, which further comprises a control system for adjusting a number and positioning of said inductors during operation and their electrical power supply as well as a number and positioning of said infrared emitters during operation and their supply of combustible gas or air/combustible gas mixture.

* * * * *